US011605312B2

(12) United States Patent
Chiu et al.

(10) Patent No.: US 11,605,312 B2
(45) Date of Patent: Mar. 14, 2023

(54) PROTECTIVE CASE FOR A COLLECTIBLE

(71) Applicant: Cheong Chiu, North York (CA)

(72) Inventors: Cheong Chiu, North York (CA); Darrin Patey, Markdale (CA)

(73) Assignee: Cheong Chiu, North York (CA)

( * ) Notice: Subject to any disclaimer, the term of this patent is extended or adjusted under 35 U.S.C. 154(b) by 0 days.

(21) Appl. No.: 17/666,660

(22) Filed: Feb. 8, 2022

(65) Prior Publication Data

US 2022/0254280 A1 Aug. 11, 2022

Related U.S. Application Data

(60) Provisional application No. 63/147,337, filed on Feb. 9, 2021.

(51) Int. Cl.

| | |
|---|---|
| ***G09F 1/12*** | (2006.01) |
| ***G09F 3/18*** | (2006.01) |
| ***A47G 1/06*** | (2006.01) |
| ***A47G 1/12*** | (2006.01) |

(52) U.S. Cl.

CPC ..... *G09F 1/12* (2013.01); *A47G 1/06* (2013.01); *A47G 1/12* (2013.01); *G09F 3/18* (2013.01); *A47G 2001/0677* (2013.01)

(58) Field of Classification Search

CPC .... G09F 1/12; G09F 3/18; A47G 1/06; A47G 1/12; A47G 2001/0677

See application file for complete search history.

(56) References Cited

U.S. PATENT DOCUMENTS

| | | | | | |
|---|---|---|---|---|---|
| 2,186,643 | A * | 1/1940 | Kaplan | A47G 1/143 | 40/748 |
| 4,878,579 | A * | 11/1989 | Hager | G09F 1/12 | 206/0.83 |
| 4,915,214 | A * | 4/1990 | Wieder | A47G 1/12 | 206/0.82 |
| 4,949,483 | A * | 8/1990 | Dobson | A47G 1/06 | 40/781 |
| 4,953,312 | A * | 9/1990 | Astolfi | A47G 1/142 | 40/790 |
| 5,010,673 | A * | 4/1991 | Connor | G09F 1/12 | 248/455 |

(Continued)

OTHER PUBLICATIONS https://www.pro-mold.com/magneticcardholders.html.
https://www.ultrapro.com/product_list.php?cPath=28.
https://www.ultrapro.com/product_list.php?cPath=90.

*Primary Examiner* — Gary C Hoge
(74) *Attorney, Agent, or Firm* — ABM Intellectual Property Inc.; Adrienne Beiber McNeil

(57) ABSTRACT

A protective case for a collectible includes a cover and a base. The cover includes a transparent panel having a top surface and a bottom surface, and a flange extending from a periphery of the bottom surface to define a recess. The flange has an inward facing surface facing the recess, and a slot extending inwardly from the inward facing surface. The base includes a transparent plate that is nested in the recess. The plate has a top edge, a bottom edge, and a sidewall extending between the top edge and the bottom edge. The sidewall includes a tab that is received and locked in the slot, to oppose removal of the plate from the recess. A collectible can be positioned between the plate and the panel and received in a seat of the plate and/or the panel.

17 Claims, 5 Drawing Sheets

(56) References Cited

U.S. PATENT DOCUMENTS

| | | | | | |
|---|---|---|---|---|---|
| 5,042,650 | A * | 8/1991 | Mayer | G09F 3/20 | 206/0.8 |
| 5,056,251 | A | 10/1991 | Connor et al. | | |
| 5,081,777 | A * | 1/1992 | Kim | A47G 1/143 | 40/652 |
| 5,121,563 | A | 6/1992 | Connor et al. | | |
| 5,224,600 | A | 7/1993 | Neugebauer | | |
| 6,029,807 | A * | 2/2000 | Love | B65D 85/48 | 206/0.82 |
| 6,295,750 | B1 | 10/2001 | Harwell et al. | | |
| 6,308,831 | B1 * | 10/2001 | Saxe | G09F 1/12 | 206/39 |
| 8,376,133 | B2 * | 2/2013 | Macor | B65D 85/58 | 206/0.8 |
| 2003/0196362 | A1 * | 10/2003 | Harwell | G09F 1/12 | 40/781 |
| 2005/0016045 | A1 * | 1/2005 | Lasher | A47G 1/06 | 40/759 |
| 2006/0248769 | A1 | 11/2006 | Rose | | |
| 2016/0000240 | A1 * | 1/2016 | Kallinger | A47G 1/065 | 40/768 |

* cited by examiner

PROTECTIVE CASE FOR A COLLECTIBLE

CROSS-REFERENCES TO RELATED APPLICATIONS

This application claims the benefit of U.S. Provisional Patent Application No. 63/147,337 filed on Feb. 9, 2021, which is incorporated herein by reference in its entirety.

FIELD

This document relates to protective cases. More specifically, this document relates to protective cases for collectibles such as trading cards, documents, and photographs.

BACKGROUND

U.S. Pat. No. 5,010,673 (Connor) discloses a plastic holder for a display item that includes a clear base panel having a top surface and a bottom surface and a top surface area greater than the display item. The top surface has a recessed portion for containing the display item and a plurality of flanges along the periphery of the base panel which extend upwardly from the top surface of the base panel. A clear insert panel also has a top surface and a bottom surface with a bottom surface area greater than the display item, and has notches along the periphery of the insert panel in positions corresponding to the flanges on the top surface of the base panel for mating with the flanges of the base panel. A mechanism for securing the insert panel to the base panel is also provided. An attachable device is provided for standing the holder upright and adjusting the viewing angle.

U.S. Patent Application Publication No. 2003/0196362 (Harwell) discloses a card display system for protecting and displaying a card, a grading label, and memorabilia. The card display system includes a first shell member having a flange extending around a perimeter of first shell member and a second member having an inner surface and an outer surface. The inner surface of the second shell member includes a card holding depression, a grading label depression, and a memorabilia depression. The second shell member is smaller than first shell member and the perimeter of second shell member is capable of engaging the flange of first shell member when the shell members are placed together.

SUMMARY

The following summary is intended to introduce the reader to various aspects of the detailed description, but not to define or delimit any invention.

Protective cases for collectibles are disclosed.

According to some aspects, a protective case includes a cover and a base. The cover includes a transparent panel and a flange. The panel has a panel top surface and a panel bottom surface, and the flange extends orthogonally from a periphery of the panel bottom surface to define a recess that is adjacent the panel bottom surface and is encircled by the flange. The flange has an inward facing surface facing the recess and an outward facing surface opposite the inward facing surface. The flange includes a slot extending inwardly from the inward facing surface. The base includes a transparent plate that has a top edge, a bottom edge, and a sidewall extending between the top edge and the bottom edge. The sidewall includes an outwardly extending tab. The cover is mountable to the base by nesting the plate in the recess to snap the tab into the slot. When plate is nested in the recess, an entirety of the plate top edge is shrouded by the flange. At least one of the plate and the panel includes a seat for receiving a collectible so that the collectible is positioned between the plate and the panel when the cover is mounted to the base.

According to some aspects, a protective case includes a cover and a base. The cover includes a transparent panel and a flange. The panel has a panel top surface and a panel bottom surface, and the flange extends orthogonally from a periphery of the panel bottom surface to define a recess that is adjacent the panel bottom surface and is encircled by the flange. The flange has an inward facing surface facing the recess and an outward facing surface opposite the inward facing surface. The flange includes a slot extending inwardly from the inward facing surface. The slot includes a slot first surface that is inclined with respect to the inward facing surface, and a slot second surface that extends from the slot first surface and orthogonally towards the inward facing surface. The base includes a transparent plate that has a top edge, a bottom edge, and a sidewall extending between the top edge and the bottom edge. The sidewall includes an outwardly extending tab, and the tab includes a tab first surface that is inclined with respect to a direction of insertion of the plate into the recess, and a tab second surface that extends inwardly from the first surface and orthogonally with respect to the direction of insertion. The cover is mountable to the base by inserting the plate into the recess along the direction of insertion to nest the plate in the recess and to snap the tab into the slot. When the cover is mounted to the base, the tab second surface abuts the slot second surface to oppose removal of the cover from the base. At least one of the plate and the panel includes a seat for receiving a collectible so that the collectible is positioned between the plate and the panel when the cover is mounted to the base.

Protective case and collectible assemblies are also disclosed.

According to some aspects, a protective case and collectible assembly includes a cover, a base, and a collectible. The cover includes a transparent panel having a top surface and a bottom surface, and a flange extending orthogonally from a periphery of the bottom surface to define a recess that is adjacent the bottom surface and is encircled by the flange. The flange has an inward facing surface facing the recess, and an outward facing surface opposite the inward facing surface. The flange includes at least a first slot extending inwardly from the inward facing surface. The base includes a transparent plate that is nested in the recess. The plate has a top edge, a bottom edge, and a sidewall extending between the top edge and the bottom edge and around a perimeter of the plate. The sidewall has an outwardly extending tab that is lockably received in the slot to oppose removal of the plate from the recess. The collectible is positioned between the plate and the panel and received in a seat of the plate and/or the panel.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION

Various apparatuses or processes or compositions will be described below to provide an example of an embodiment of the claimed subject matter. No embodiment described below limits any claim and any claim may cover processes or apparatuses or compositions that differ from those described below. The claims are not limited to apparatuses or processes or compositions having all of the features of any one apparatus or process or composition described below or to features common to multiple or all of the apparatuses or processes or compositions described below. It is possible that an apparatus or process or composition described below is not an embodiment of any exclusive right granted by issuance of this patent application. Any subject matter described below and for which an exclusive right is not granted by issuance of this patent application may be the subject matter of another protective instrument, for example, a continuing patent application, and the applicants, inventors or owners do not intend to abandon, disclaim or dedicate to the public any such subject matter by its disclosure in this document.

Generally disclosed herein is a protective case for a collectible. As used herein, the term "collectible" refers to any generally planar object that is to be protected and displayed, such as (but not limited to) a trading card (e.g. a sports card, a game card, a fantasy art card, etc.), a keepsake, a document (e.g. a diploma), and/or a photograph. The protective case may also be configured to display information related to the collectible. For example, the protective case may also be configured display a trading card and a grading label for the trading card. Notably, the protective case is configured to encase the collectible so that the collectible cannot be readily removed from the case (e.g. so that the collectible cannot be removed from the case without destroying or damaging the case, or cannot be removed from the case without significant effort). This may be particularly beneficial for the purpose of collectibles such as high-value trading cards, which may be subject to tampering. Furthermore, the protective case is configured to obviate the need for specialized equipment to permanently encase the collectible. That is, instead of relying on specialized techniques such as sonic welding to permanently encase the collectible, the protective case can employ mechanical fasteners (e.g. tabs that lock into a slot) to encase the collectible.

Figure 1:
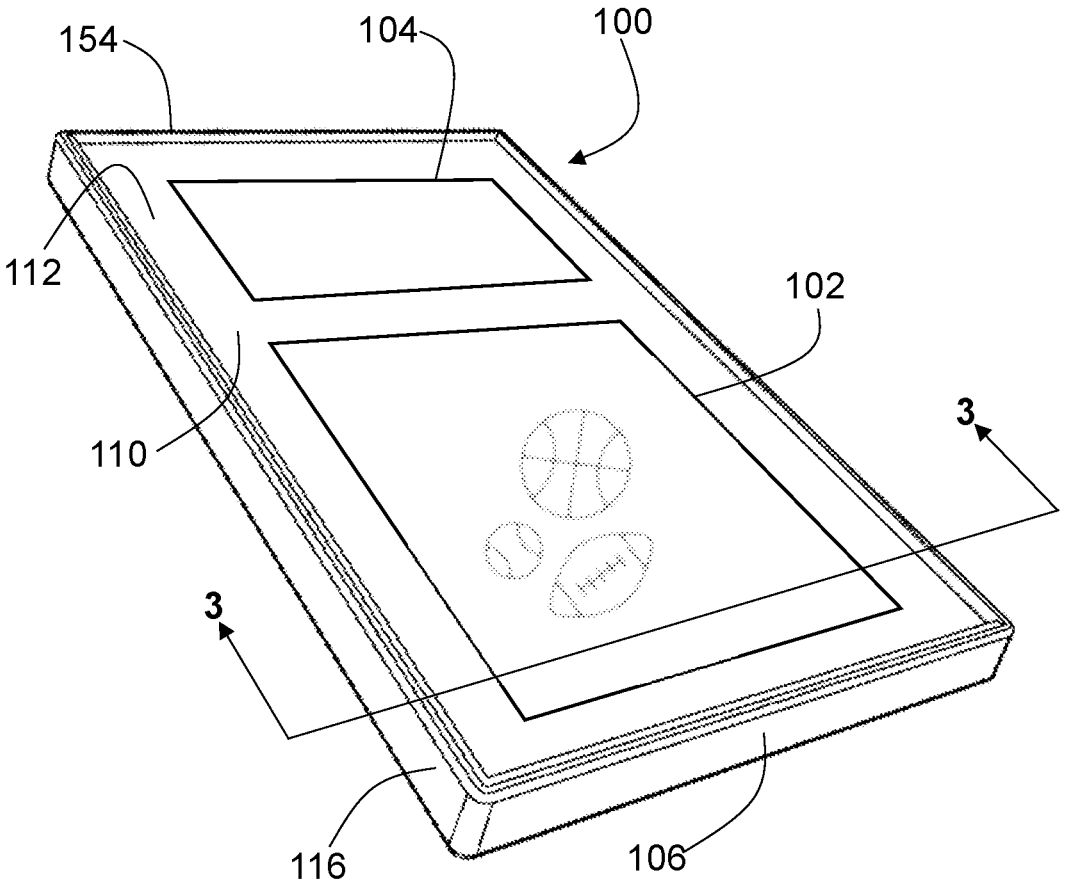
FIG. 1 is a perspective view of an example protective case, housing a trading card and information label.

Referring now to FIG. 1, a first example of a protective case 100 is shown. In the example shown, the case 100 contains a trading card 102 and an information label 104; however, as mentioned above, the case 100 can be configured for various other collectibles.

Figure 2:
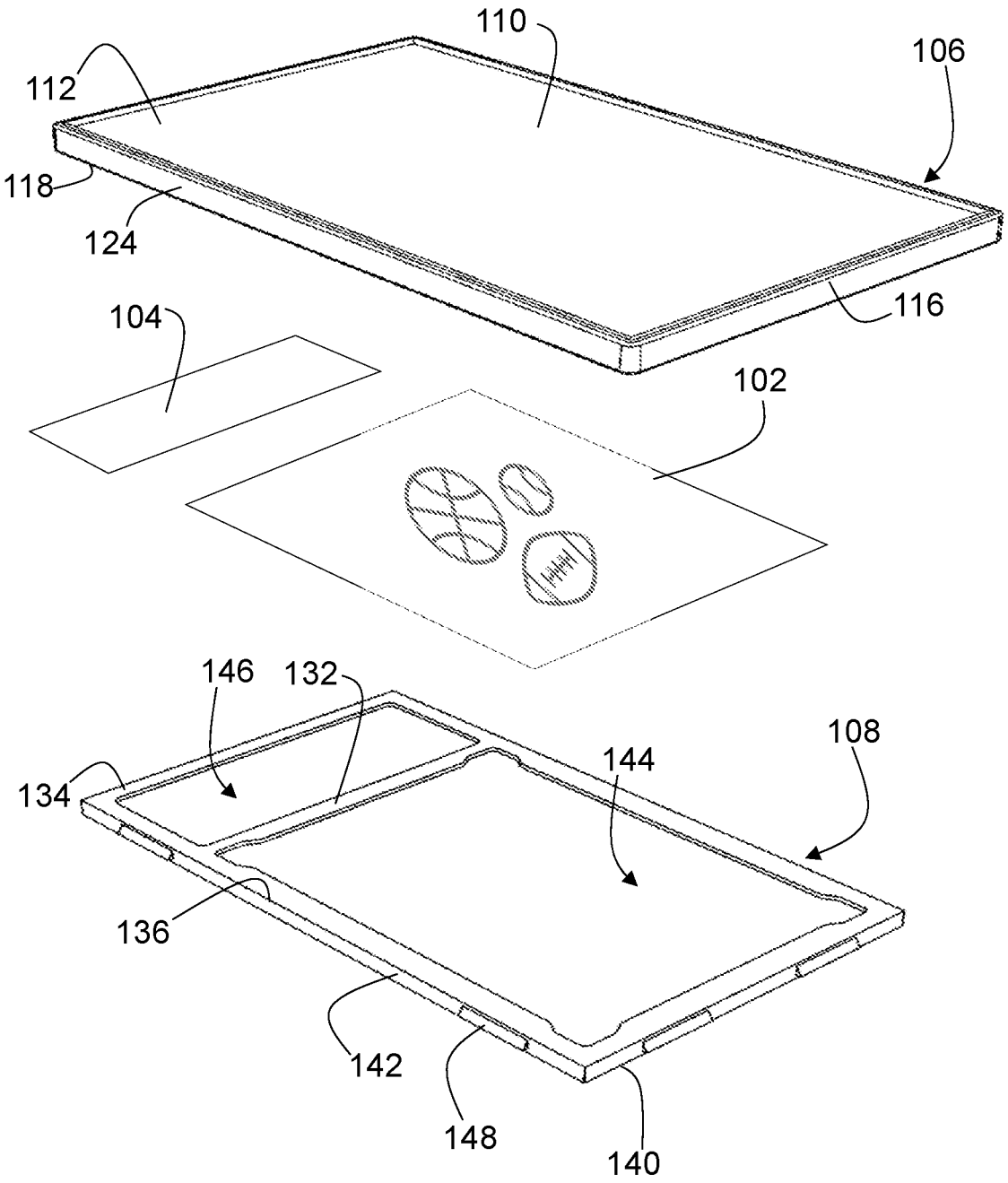
FIG. 2 is an exploded view of the protective case, trading card, and information label of FIG. 1.
Figure 3:
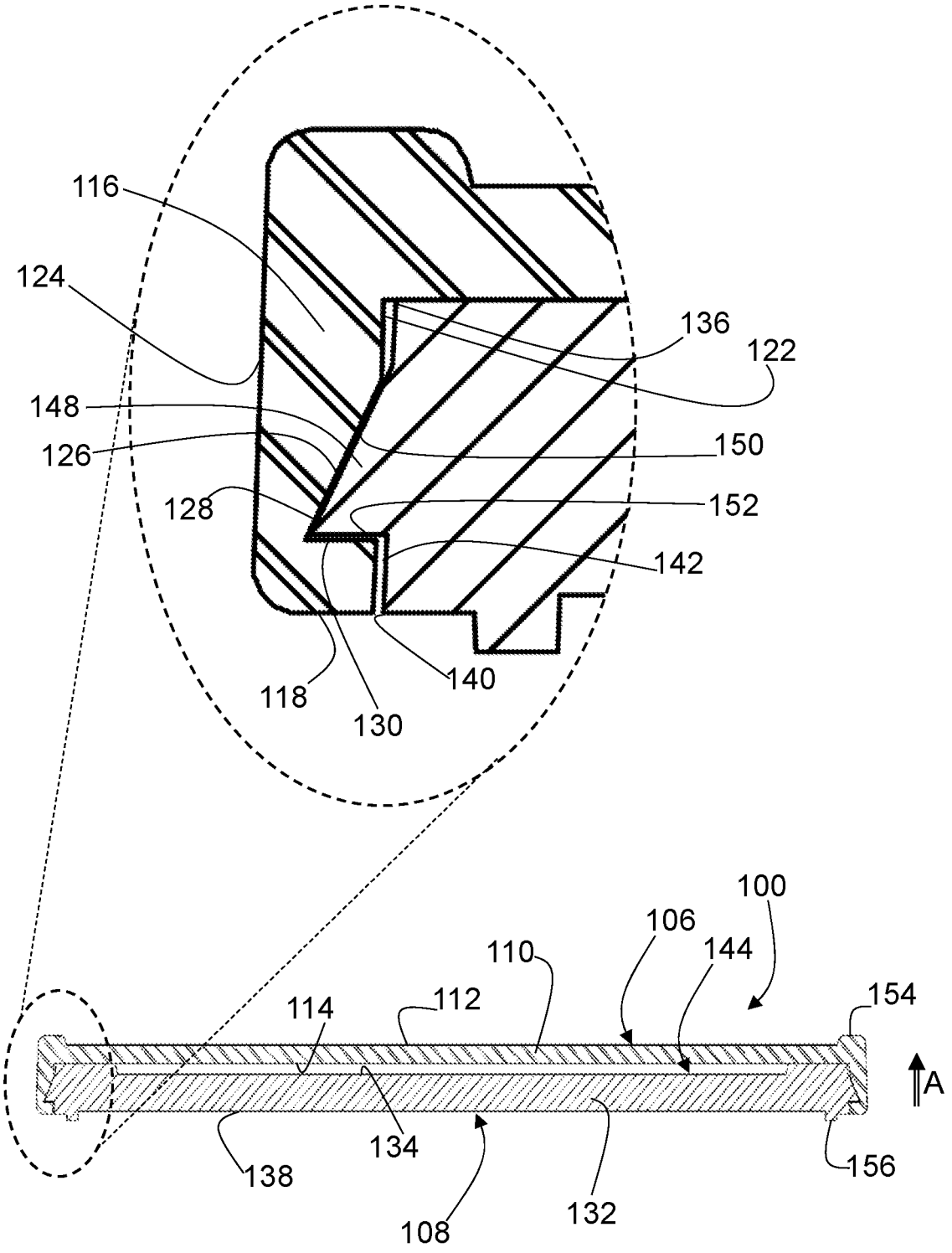
FIG. 3 is a cross-section taken along line 3-3 in FIG. 1, with the trading card not shown, and with a portion of the protective case enlarged to show detail.

Referring to FIGS. 2 and 3, in the example shown, the case 100 includes a cover 106 and a base 108. As will be described in greater detail below, the cover 106 and the base 108 can snap together, by inserting the base 108 into the cover 106 along a direction of insertion, indicated by arrow A in FIG. 3. Furthermore, the base 108 and cover 106 are snapped together, with the trading card 102 and information label 104 therebetween, so that the trading card 102 and label 104 are protected by the case 100 and can be viewed while within the case 100, and so that the case 100 cannot readily be opened (e.g. cannot be opened without destroying or damaging the case 100, or without significant effort). To more clearly show the features of the case 100, the trading card 102 and information label 104 are omitted in FIG. 3.

Figure 4:
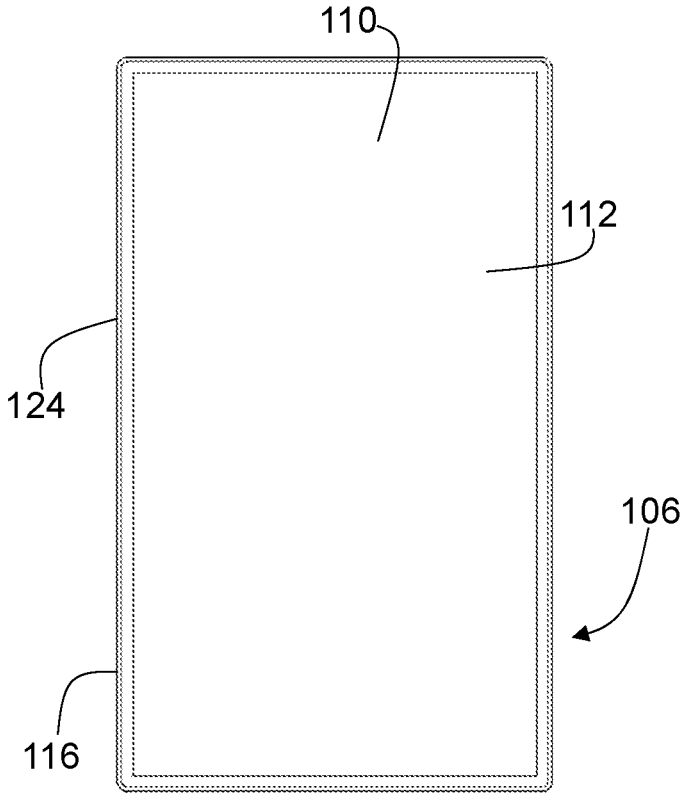
FIG. 4 is a top view of the cover of the protective case of FIGS. 1 to 3.
Figure 5:
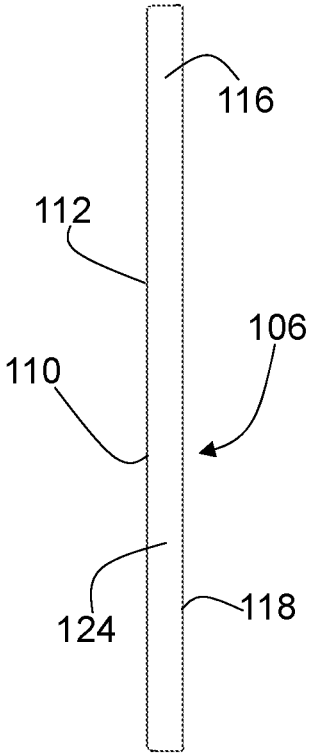
FIG. 5 is a side view of the cover of FIG. 4.
Figure 6:
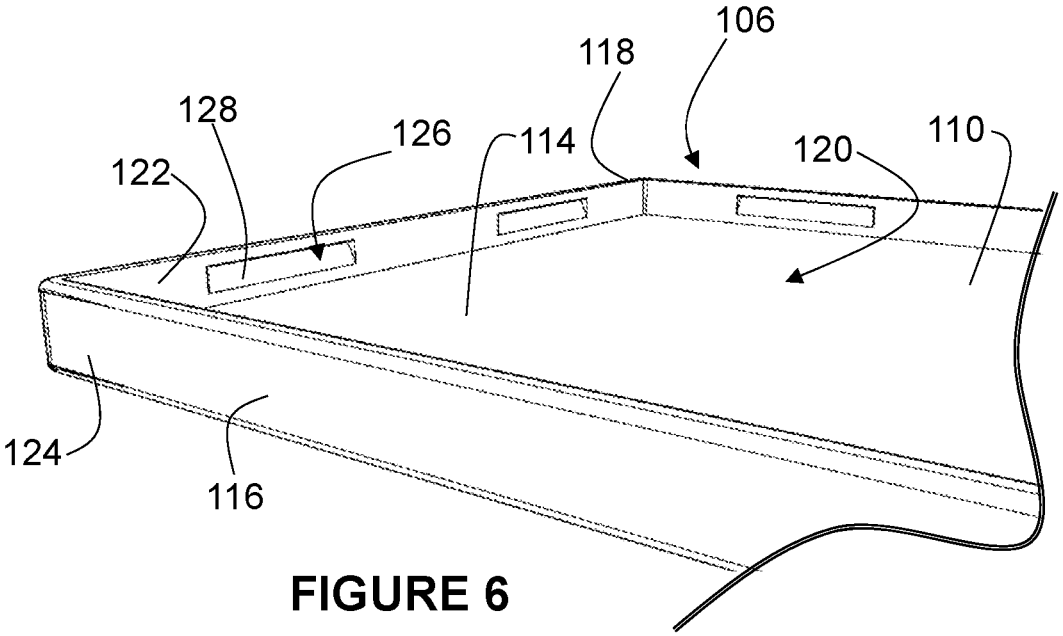
FIG. 6 is a partial bottom perspective view of the cover of FIGS. 4 and 5.

Referring now to FIGS. 4 to 6, the cover 106 is shown in greater detail. In the example shown, the cover 106 is generally rectangular (although other shapes are possible) and includes a panel 110 that is transparent to allow for viewing of the trading card 102 (not shown in FIGS. 4 to 7) through the panel 110. The panel 110 has a top surface 112 and a bottom surface 114 (also referred to herein as a 'panel top surface' and a 'panel bottom surface', respectively). In use, the top surface 112 faces away from the trading card 102, and the bottom surface 114 faces towards the trading card 102.

The cover 106 further includes a flange 116, which extends orthogonally from a periphery of the bottom surface 114. As used herein, the term 'orthogonally' includes angles of 90 degrees, plus or minus 10 degrees. The flange 116 and has a free edge 118 that is spaced from the bottom surface 114. The flange 116 extends continuously around the entire periphery of the bottom surface 114, and defines a recess 120 that is adjacent the bottom surface 114 and that is encircled by the flange 116.

The flange 116 has an inward facing surface 122, which faces the recess 120, and an outward facing surface 124 opposite the inward facing surface 122. The flange 116 further includes a set of slots 126 that extend inwardly from the inward facing surface 122. For simplicity, only one of the slots 126 is labelled in the Figures. In the example shown, the flange 116 includes eight slots, namely a first slot, a second slot, and so on. The slots 126 are spaced apart around the flange 116, particularly with two slots 126 on each of the four sides of the flange 116. In alternative examples, another number of slots may be provided, such as a single slot (e.g. a single slot that extends entirely around the flange 116), or more than two slots on each of the four sides of the flange 116.

As will be described below, the slots 126 are configured as locking slots, so that tabs received therein cannot readily be removed. In the example shown, each slot 126 is triangular in cross section, and tapers going towards the panel 110 from the free edge 118 of the flange 116. That is, referring back to FIG. 3, each slot 126 includes a first surface 128 that is inclined with respect to the direction of insertion A, and inclined with respect to the inward facing surface 122 (i.e. inclined so that the first surface 128 flares away from the inward facing surface 122 when going from the panel towards the free edge 118 of the flange 116), and a second surface 130 that extends from the first surface 128, and extends orthogonally towards the inward facing surface 122 (and orthogonally with respect to the direction of insertion A). In alternative examples, the slot may be of another cross-sectional shape or another configuration.

Figure 7:
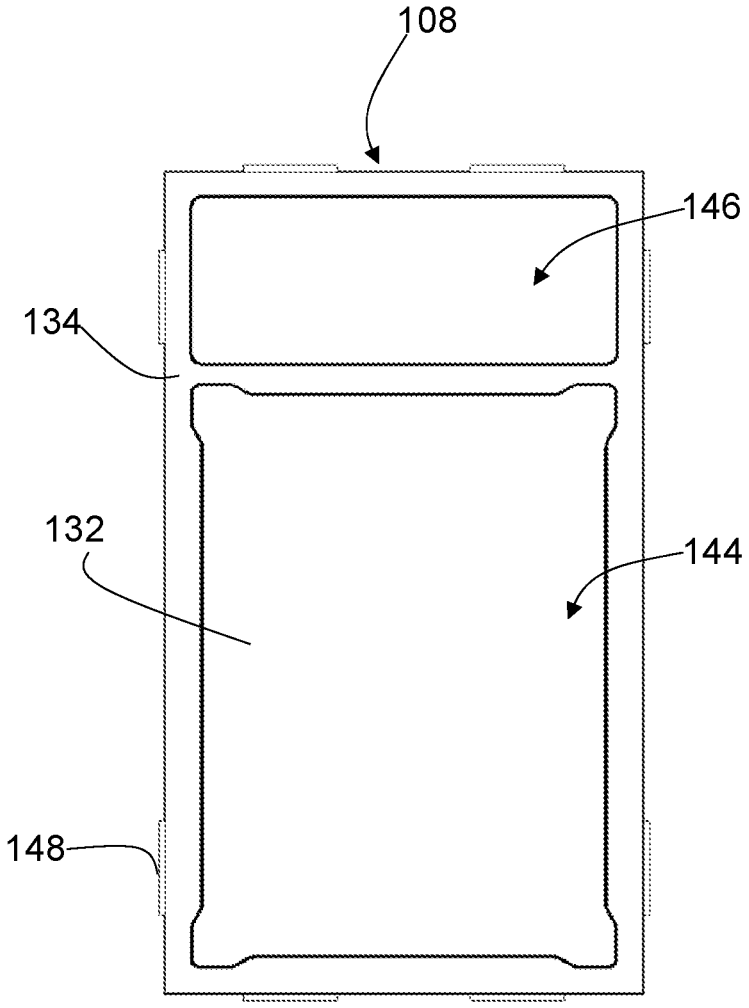
FIG. 7 is a top view of the base of the protective case of FIGS. 1 to 3.
Figure 8:
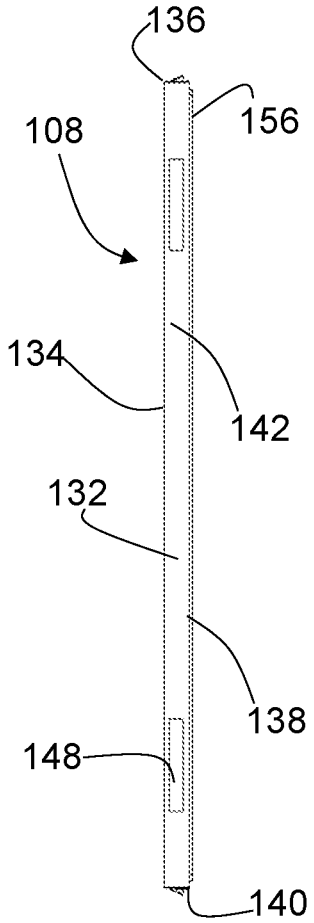
FIG. 8 is a side view of the base of FIG. 7.
Figure 9:
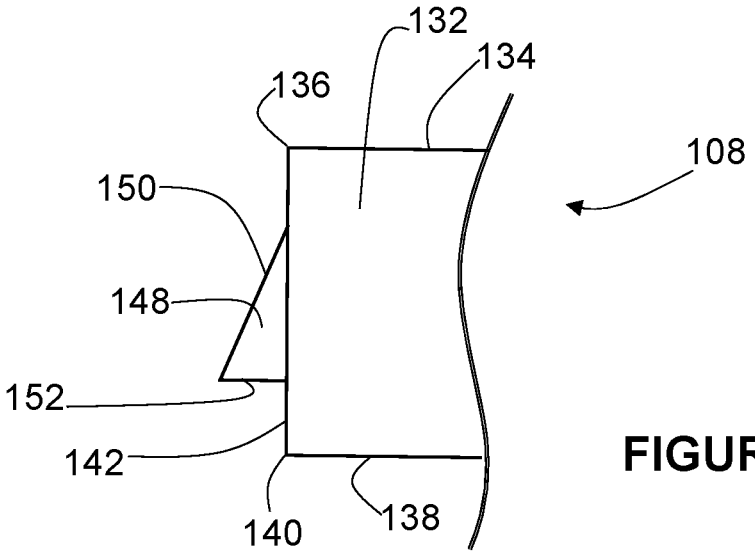
FIG. 9 is a partial end view of the base of FIGS. 7 and 8.

Referring now to FIGS. 7 to 9, the base 108 is shown in greater detail. In the example shown, the base 108 is generally rectangular (although other shapes are possible) and includes a plate 132, which is transparent to allow for viewing of the trading card 102 (not shown in FIGS. 7 to 9) through the plate 132. The plate 132 has a top surface 134 (also referred to herein as a 'plate top surface') that is bounded by a top edge 136, and a bottom surface 138 (also referred to herein as a 'plate bottom surface') that is bounded by bottom edge 140. The top edge 136 and the bottom edge 140 extend around the perimeter of the plate 132. The plate 132 further has a sidewall 142, which extends between the top edge 136 and the bottom edge 140, and extends around the perimeter of the plate 132.

As can be seen in FIG. 7, the plate 132 includes a first seat 144 for receiving the trading card 102, and a second seat 146 for receiving the information label 104. The seats 144, 146 are in the form of a depressions formed in the top surface 134 of the plate 132. In the example shown, the seats 144, 146 are generally rectangular and are sized to receive standard sized trading cards and information labels. In alternative examples, the seats 144, 146 may be of another shape and/or size, depending on the collectible that is intended to be protected by the case. In further alternative examples, the base 108 can include another number of seats, such as one seat or more than two seats. In further alternative examples, the seat(s) can be part of the cover 106 (e.g. formed in the bottom surface 114 of the panel 110) rather than the base 108.

Referring still to FIGS. 7 to 9, the sidewall 142 includes a set of outwardly extending tabs 148. For simplicity, only one of the tabs 148 is labelled in the Figures. In the example shown, base 108 includes eight tabs 148, namely a first tab, a second tab, and so on. The tabs 148 are spaced apart around the sidewall 142, particularly with two tabs 148 on each of the four sides of the sidewall 142. In alternative examples, another number of tabs 148 may be provided, such as a single tab (e.g. a single tab that extends entirely around the sidewall 142), or more than two tabs on each of the four sides of the sidewall 142. The number of tabs 148 may or may not be the same as the number of slots 126 in the cover 106. For example, the base 108 may include eight tabs 148 as shown, while the cover 106 may include a single slot that extends entirely around the flange 116, for receipt of all eight of the tabs 148.

As will be described below, the tabs 148 are configured as locking tabs, so that they snap into the slots 126 of the cover 106 and cannot readily be removed therefrom. In the example shown, each tab 148 is triangular in cross section, and tapers going from the bottom edge 140 towards the top edge 136. That is, each tab 148 includes a first surface 150 (also referred to herein as a 'tab first surface') that is inclined with respect to the direction of insertion A (shown in FIG. 3), so that the first surface 150 flares outwardly when going from the top edge 136 towards the bottom edge 140). Each tab 148 further includes a second surface 152 (also referred to herein as a 'tab second surface') that extends inwardly from the first surface 150 and orthogonally with respect to the direction of insertion A. In alternative examples, the tabs 148 may be of another cross-sectional shape or another configuration.

The base 108 and the cover 106 can optionally be fabricated from a transparent plastic.

Referring back to FIG. 2, in use, the trading card 102 and information label 104 can be seated in the first seat 144 and second seat 146, respectively. Then, the cover 106 can be mounted to the base 108. Particularly, referring also to FIG. 3, the plate 132 of the base 108 can be aligned with the recess 120 (not labelled in FIGS. 2 and 3) of the cover 106, and force can be applied to insert the plate 132 into the recess 120 along the direction of insertion A, to nest the plate 132 into the recess 120. With the application of force, the first surface 150 of the tabs 148 will press against the flange 116 and cause the flange 116 to flex outwardly as the plate 132 moves into the recess 120. The tabs 148 will then snap into the slots 126 (i.e. the first tab will snap into the first slot, the second tab into the second slot, and so on), and the flange 116 will snap back to its original shape. As can be seen in FIG. 3, when the cover 106 is mounted to the base 108, the second surface 152 of each respective tab 148 abuts the second surface 130 of each respective slot 126, to oppose removal of the cover 106 from the base 108. Furthermore, when the cover 106 is mounted to the base 108, the top edge 136 of the plate 132, in its entirety, is shrouded by the flange 116. This hinders gripping of the top edge 136 to remove the cover 106 from the base 108. Furthermore, when the cover 106 is mounted to the base 108, the bottom edge 140 of the plate 132 is flush with the free edge 118 of the flange 116. This further hinders removal of the cover 106 from the base 108, as the bottom edge 140 cannot be readily gripped to remove the cover 106 from the base 108. Accordingly, in order to remove the cover 106 from the base 108, significant effort would be required. For example, the case 100 would have to be destroyed or damaged, for example by inserting a tool such as a screwdriver between the sidewall 142 of the base 108 and the inward facing surface 122 of the flange 116, and applying a prying force. This would damage and/or destroy the base 108 and/or the cover 106 (e.g. by breaking one or more of the tabs 148 or cracking the flange 116). For further example, significant pressure and/or force would be required to manually manipulate the cover 106 and the base 108 to remove the cover 106 from the base 108. The case 100 thus may prevent tampering.

Referring still to FIG. 3, in the example shown, the cover 106 and the base 108 each include a respective rib 154, 156, to facilitate stacking of several cases.

While the above description provides examples of one or more processes or apparatuses or compositions, it will be appreciated that other processes or apparatuses or compositions may be within the scope of the accompanying claims.

To the extent any amendments, characterizations, or other assertions previously made (in this or in any related patent applications or patents, including any parent, sibling, or child) with respect to any art, prior or otherwise, could be construed as a disclaimer of any subject matter supported by the present disclosure of this application, Applicant hereby rescinds and retracts such disclaimer. Applicant also respectfully submits that any prior art previously considered in any related patent applications or patents, including any parent, sibling, or child, may need to be re-visited.

We claim:

1. A protective case comprising:

a cover comprising a transparent panel and a flange, wherein the panel has a panel top surface and a panel bottom surface, wherein the flange extends orthogonally from a periphery of the panel bottom surface to a free edge of the flange, to define a recess that is adjacent the panel bottom surface and is encircled by the flange, wherein the flange has an inward facing surface facing the recess and an outward facing surface opposite the inward facing surface, and wherein the flange comprises a slot extending into the flange from the inward facing surface;

a base comprising a transparent plate, wherein the plate has a top edge, a bottom edge, and a sidewall extending between the top edge and the bottom edge, and wherein the sidewall includes an outwardly extending tab;

wherein the cover is mountable to the base by nesting the plate in the recess to snap the tab into the slot, whereby when the plate is nested in the recess an entirety of the top edge of the plate is shrouded by the flange and the bottom edge of the plate is flush with the free edge of the flange; and wherein at least one of the plate and the panel comprises a seat for receiving a collectible so that the collectible is positioned between the plate and the panel when the cover is mounted to the base.

2. The protective case of claim 1, wherein the plate comprises the seat.

3. The protective case of claim 2, wherein the plate further comprises a second seat for receiving a label.

4. The protective case of claim 1, wherein the tab is triangular in cross-sectional shape and tapers going from the bottom edge towards the top edge.

5. The protective case of claim 4, wherein the slot is triangular in cross-sectional shape and tapers going towards the panel.

6. The protective case of claim 1, wherein the tab comprises a tab first surface that is inclined with respect to a direction of insertion of the plate into the recess, and a tab second surface that extends inwardly from the tab first surface and orthogonally with respect to the direction of insertion.

7. The protective case of claim 6, wherein the first slot comprises a slot first surface that is inclined with respect to the inward facing surface, and a slot second surface that extends from the slot first surface and orthogonally towards the inward facing surface.

8. The protective case of claim 7, wherein when the cover is mounted to the base, the tab second surface abuts the slot second surface to oppose removal of the cover from the base.

9. The protective case of claim 1, wherein the tab is one of a set of tabs, and each tab of the set of tabs is spaced apart around plate; and the slot is one of a set of slots, and each slot of the set of slots is spaced apart around the flange.

10. A protective case comprising:

a cover comprising a transparent panel and a flange, wherein the panel has a panel top surface and a panel bottom surface, wherein the flange extends orthogonally from a periphery of the panel bottom surface to a free edge of the flange, to define a recess that is adjacent the panel bottom surface and is encircled by the flange, wherein the flange has an inward facing surface facing the recess and an outward facing surface opposite the inward facing surface, wherein the flange comprises a slot extending into the flange from the inward facing surface, and wherein the slot comprises a slot first surface that is inclined with respect to the inward facing surface, and a slot second surface that extends from the slot first surface and orthogonally towards the inward facing surface;

a base comprising a transparent plate, wherein the plate has a top edge, a bottom edge, and a sidewall extending between the top edge and the bottom edge, and wherein the sidewall comprises an outwardly extending tab that includes a tab first surface that is inclined with respect to a direction of insertion of the plate into the recess, and a tab second surface that extends inwardly from the first surface and orthogonally with respect to the direction of insertion;

wherein the cover is mountable to the base by inserting the plate into the recess along the direction of insertion to nest the plate in the recess and to snap the tab into the slot, and wherein when the cover is mounted to the base, the tab second surface abuts the slot second surface to oppose removal of the cover from the base, and the bottom edge of the plate is flush with the free edge of the flange; and wherein at least one of the plate and the panel comprises a seat for receiving a collectible so that the collectible is positioned between the plate and the panel when the cover is mounted to the base.

11. The protective case of claim 10, wherein when the plate is nested in the recess an entirety of the top edge of the plate is shrouded by the flange.

12. The protective case of claim 10, wherein the plate comprises the seat.

13. The protective case of claim 12, wherein the plate further comprises a second seat for receiving a label.

14. The protective case of claim 10, wherein the tab is triangular in cross-sectional shape and tapers going from the bottom edge towards the top edge.

15. The protective case of claim 14, wherein the slot is triangular in cross-sectional shape and tapers going towards the panel.

16. The protective case of claim 10, wherein the tab is one of a set of tabs, and each tab of the set of tabs is spaced apart around plate; and the slot is one of a set of slots, and each slot of the set of slots is spaced apart around the flange.

17. A protective case and collectible assembly, comprising:

a cover comprising a transparent panel having a top surface and a bottom surface, and a flange extending orthogonally from a periphery of the bottom surface to a free edge of the flange, to define a recess that is adjacent the bottom surface and is encircled by the flange, wherein the flange has an inward facing surface facing the recess, and an outward facing surface opposite the inward facing surface, and wherein the flange comprises at least a first slot extending into the flange from the inward facing surface;

a base comprising a transparent plate that is nested in the recess, wherein the plate has a top edge, a bottom edge, and a sidewall extending between the top edge and the bottom edge and around a perimeter of the plate, wherein the bottom edge of the plate is flush with the free edge of the flange, and wherein the sidewall has an outwardly extending tab that is lockably received in the slot to oppose removal of the plate from the recess; and a collectible positioned between the plate and the panel and received in a seat of the plate and/or the panel.

* * * * *